US011950698B2

(12) United States Patent
Lau

(10) Patent No.: US 11,950,698 B2
(45) Date of Patent: Apr. 9, 2024

(54) DESKTOP RISER WITH LOCKING ASSEMBLY

(71) Applicant: Colebrook Bosson & Saunders (Products) Limited, London (GB)

(72) Inventor: Alex Lau, London (GB)

(73) Assignee: COLEBROOK BOSSON & SAUNDERS (PRODUCTS) LIMITED, London (GB)

( * ) Notice: Subject to any disclaimer, the term of this patent is extended or adjusted under 35 U.S.C. 154(b) by 0 days.

(21) Appl. No.: 17/899,896

(22) Filed: Aug. 31, 2022

(65) Prior Publication Data

US 2024/0065432 A1 Feb. 29, 2024

(51) Int. Cl.

| | |
|---|---|
| ***A47B 9/16*** | (2006.01) |
| ***A47B 3/02*** | (2006.01) |
| ***A47B 13/02*** | (2006.01) |

(52) U.S. Cl.

CPC ..... *A47B 9/16* (2013.01); *A47B 13/02* (2013.01); *A47B 2003/025* (2013.01)

(58) Field of Classification Search

CPC ..... A47B 9/16; A47B 13/02; A47B 2003/025; A47B 21/02

See application file for complete search history.

(56) References Cited

U.S. PATENT DOCUMENTS

| | | | |
|---|---|---|---|
| 8,001,909 | B2 | 8/2011 | Overgaard et al. |
| 8,052,208 | B2 | 11/2011 | Kim et al. |
| 9,247,806 | B2 | 2/2016 | Lorenzen et al. |
| 9,326,598 | B1 * | 5/2016 | West ..... A47B 23/04 |
| 9,635,929 | B1 * | 5/2017 | Wu ..... A47B 23/043 |
| 9,700,136 | B1 | 7/2017 | Zebarjad |
| 9,808,080 | B2 | 11/2017 | Chung |
| 9,820,565 | B2 | 11/2017 | Zebarjad et al. |
| 10,034,538 | B1 | 7/2018 | Masters et al. |
| 10,083,282 | B2 * | 9/2018 | Rangaraj ..... H04L 63/0428 |
| 10,092,089 | B1 * | 10/2018 | Yuan ..... A47B 3/002 |
| 10,602,840 | B2 | 3/2020 | Ergun et al. |
| 10,694,841 | B2 * | 6/2020 | Zhu ..... A47B 9/02 |
| 10,842,257 | B2 | 11/2020 | Fletcher-Price et al. |

(Continued)

FOREIGN PATENT DOCUMENTS

| | | | |
|---|---|---|---|
| EP | 3714734 | A1 | 9/2020 |
| WO | 2020107380 | A1 | 6/2020 |
| WO | 2021069852 | A1 | 4/2021 |

*Primary Examiner* — Daniel J Rohrhoff

(74) *Attorney, Agent, or Firm* — MICHAEL BEST & FRIEDRICH LLP

(57) ABSTRACT

A height adjustable work surface includes a platform and a height adjustment assembly moveably connected to the platform. A leg assembly is connected to the height adjustment assembly and moveably connected to the platform. The leg assembly is moveable between a raised position and a lowered position. A locking assembly is moveably connected to the platform. The locking assembly is configured to engage the height adjustment assembly to selectively secure the leg assembly in the raised position and the lowered position. The locking assembly includes a handle and a latch. At least a portion of the latch is moveable between a first position and a second position. The latch includes a gravity actuated lockout mechanism configured to prevent movement of the latch to the second position unless the platform is in a normal operating orientation.

20 Claims, 13 Drawing Sheets

(56) References Cited

U.S. PATENT DOCUMENTS

| | | | | |
|---|---|---|---|---|
| 10,905,232 | B2 | 2/2021 | Verhappen | |
| 11,083,282 | B1 * | 8/2021 | Liu | A47B 9/16 |
| 2018/0146775 | A1 * | 5/2018 | You | A47B 9/16 |
| 2018/0255919 | A1 * | 9/2018 | Swartz | A47B 9/12 |
| 2020/0281349 | A1 | 9/2020 | Grabowski et al. | |
| 2020/0359782 | A1 * | 11/2020 | Ballendat | A47B 9/12 |
| 2022/0330692 | A1 * | 10/2022 | Tao | A47B 21/02 |
| 2022/0369806 | A1 * | 11/2022 | Lau | A47B 9/16 |
| 2023/0072671 | A1 * | 3/2023 | Yuan | B66F 7/065 |
| 2023/0133183 | A1 * | 5/2023 | Choi | A47B 3/08 108/106 |
| 2023/0225500 | A1 * | 7/2023 | Choi | A47B 3/08 108/116 |

* cited by examiner

DESKTOP RISER WITH LOCKING ASSEMBLY

FIELD

Various exemplary embodiments relate to height adjustable work surfaces.

BACKGROUND

Modern workplace environments and work stations, as well as the demands for mobility and body positioning are vastly changed from earlier workplaces, where desks and chairs were provided to support workers in typically upright seating postures. Modern workplaces are adapting both sitting and standing worker positions allowing user mobility and range of motion to facilitate job tasks.

Providing the option to either sit or stand at a workstation can allow a user to alternate working positions, preventing injury due to being set in a specific position over an entire day. While workstations (e.g., tables or desks) with a raise and lower mechanism are available, these can be expensive and are not ideal for each environment. Convertible platforms that are placed on top of a user's standard sitting desk are also available, however these are designed for stationary use, decreasing their flexibility and flexibility in the workplace environment.

SUMMARY

In certain aspects, a height adjustable work surface includes a platform and a height adjustment assembly moveably connected to the platform. A leg assembly is connected to the height adjustment assembly and moveably connected to the platform. The leg assembly is moveable between a raised position and a lowered position. A locking assembly is moveably connected to the platform. The locking assembly is configured to engage the height adjustment assembly to selectively secure the leg assembly in the raised position and the lowered position. The locking assembly includes a handle and a latch. At least a portion of the latch is moveable between a first position and a second position. The latch includes a gravity actuated lockout mechanism configured to prevent movement of the latch to the second position unless the platform is in a normal operating orientation.

In certain aspects, a height adjustable work surface includes a platform and a height adjustment assembly moveably connected to the platform. A leg assembly is connected to the height adjustment assembly and moveably connected to the platform. The leg assembly is moveable between a raised position and a lowered position. A handle is moveably connected to the platform. The handle is configured to engage the height adjustment assembly to selectively secure the leg assembly in the raised position and the lowered position. A latch is connected to the platform. At least a portion of the latch is moveable between a first position configured to engage the handle and a second position configured to allow the handle to pass around the latch. The latch includes a lockout mechanism configured to be automatically engaged and disengaged based on the orientation of the platform. When the lockout mechanism is engaged it prevents movement of the to the second position.

In certain aspects, a height adjustable work surface includes a platform and a height adjustment assembly moveably connected to the platform. A leg assembly is connected to the height adjustment assembly and moveably connected to the platform. The leg assembly is moveable between a raised position and a lowered position. A handle is moveably connected to the platform. The handle is configured to engage the height adjustment assembly to selectively secure the leg assembly in the raised position and the lowered position. A latch body is connected to the platform, the latch body including a track. A ball is received in the track and moveable between an engaged position and a disengaged position. An actuator is pivotally connected to the latch body. The actuator is moveable between a first position configured to engage the handle and a second position configured to allow the handle to pass around the actuator. The ball is configured to prevent movement of the actuator to the second position when the ball is in the engaged position.

BRIEF DESCRIPTION OF THE DRAWINGS

The aspects and features of various exemplary embodiments will be more apparent from the description of those exemplary embodiments taken with reference to the accompanying drawings.

DETAILED DESCRIPTION OF EXEMPLARY EMBODIMENTS

Various exemplary embodiments described herein are directed to a height adjustable work surface. Various structural features and alternative embodiments can be incorporated into the height adjustable work surface, for example as shown in U.S. patent application Ser. No. 17/765,395 and PCT Published Application No. WO2021/069852, the disclosures of which are hereby incorporated by reference in their entirety.

Figure 3:
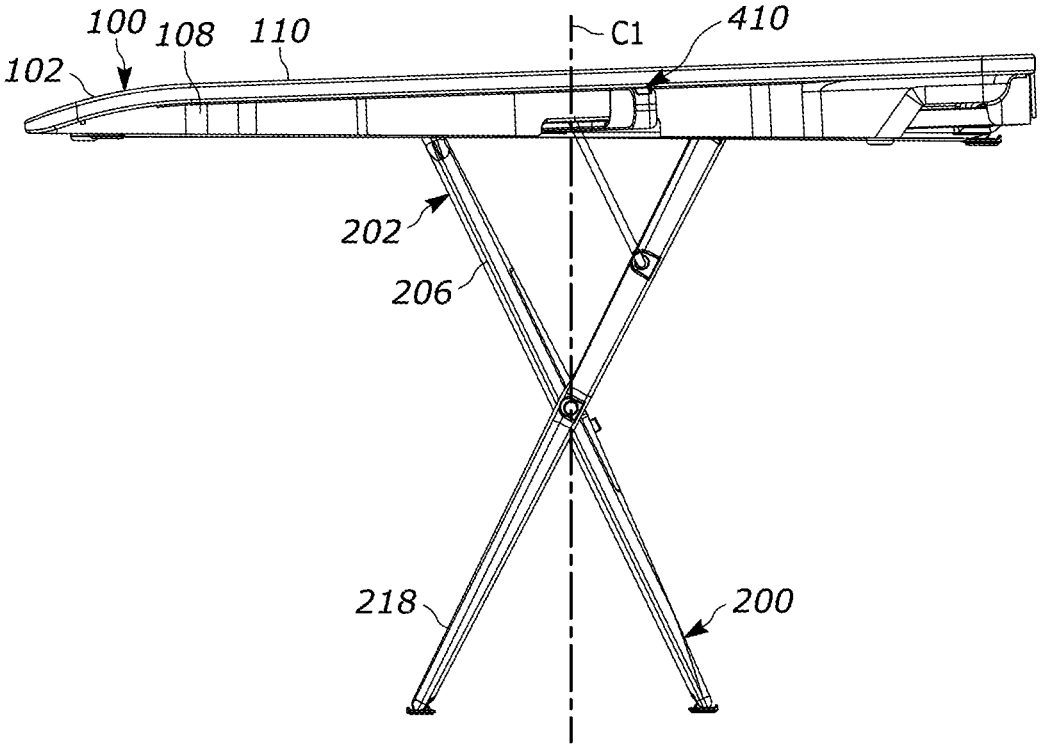
FIG. 3 is side view of the height adjustable work surface in a raised position.
Figure 4:
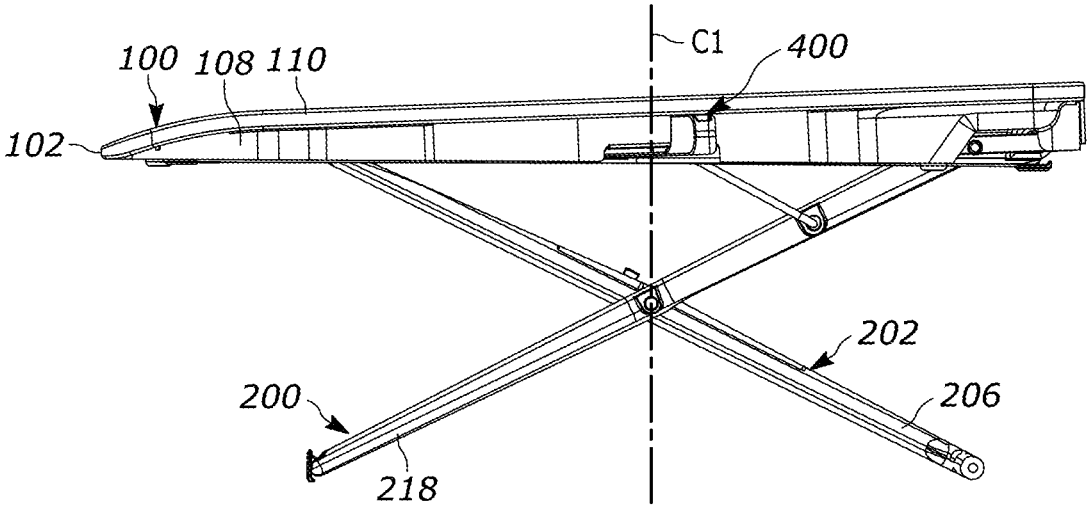
FIG. 4 is a side view of the height adjustable work surface in an intermediate position.

In accordance with various exemplary embodiments, a height adjustable desktop riser work surface includes a platform 100, a leg assembly 200, a height adjustment assembly 300, and a locking assembly 400. The desktop riser is configured to be positioned on a horizontal surface, such as an existing desk or table. The platform forms a surface to support a user's work material (e.g., keyboards, computers, papers, etc.) between a raised, standing position (FIGS. 1-3), a lowered, desk level position (FIG. 5), and a number of intermediate positions (e.g., FIG. 4) as desired. The desktop riser can be configured so that the leg structure is always aligned with a midpoint of the platform C1 as it is raised and lowered, preventing the desktop riser from cantilevering out toward the user. For example, the midpoint or center of mass of the platform 100 can be aligned with a pivotal connection in the leg assembly 200 through which the legs are raised and lowered.

Figure 5:
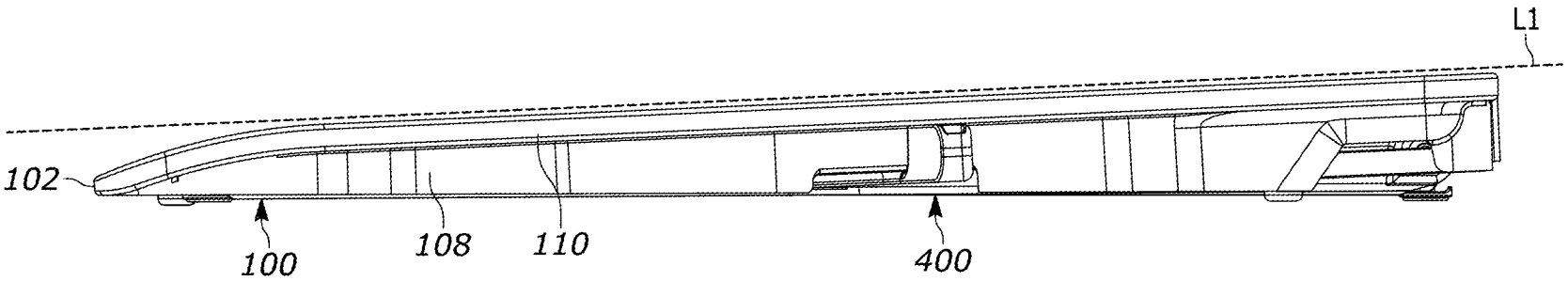
FIG. 5 is a side view of the height adjustable work surface in a lowered position.
Figure 6:
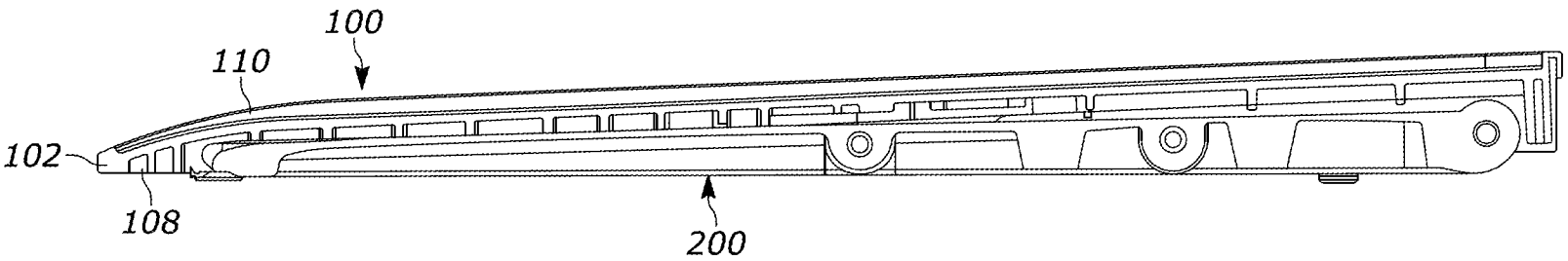
FIG. 6 is a sectional view of FIG. 5 showing the leg assembly positioned in the platform.

As best shown in the lowered position of FIG. 5, top or working surface of the platform 100 slopes downwardly toward the user. Stated another way, the height of the platform 100 decreases toward the user. For example, the height of the platform 100 slopes toward the support surface from the rear to the front of the platform along a line Li. In an exemplary embodiment the height of the platform 100 has a 2 degree angle toward the user. The slope of the platform 100 working surface reduces the height/thickness at the front edge of the platform to minimize the user's need to raise their arms higher than necessary and to avoid pressure points at the edge of the platform 100. The platform 100 also can include a downward radiused front edge detail, further reducing any potential pressure points on the user's forearms. In the lowered position, the leg assembly 200 is tucked into a cavity in the platform 100 to provide a low profile in appearance and use.

Figure 1:
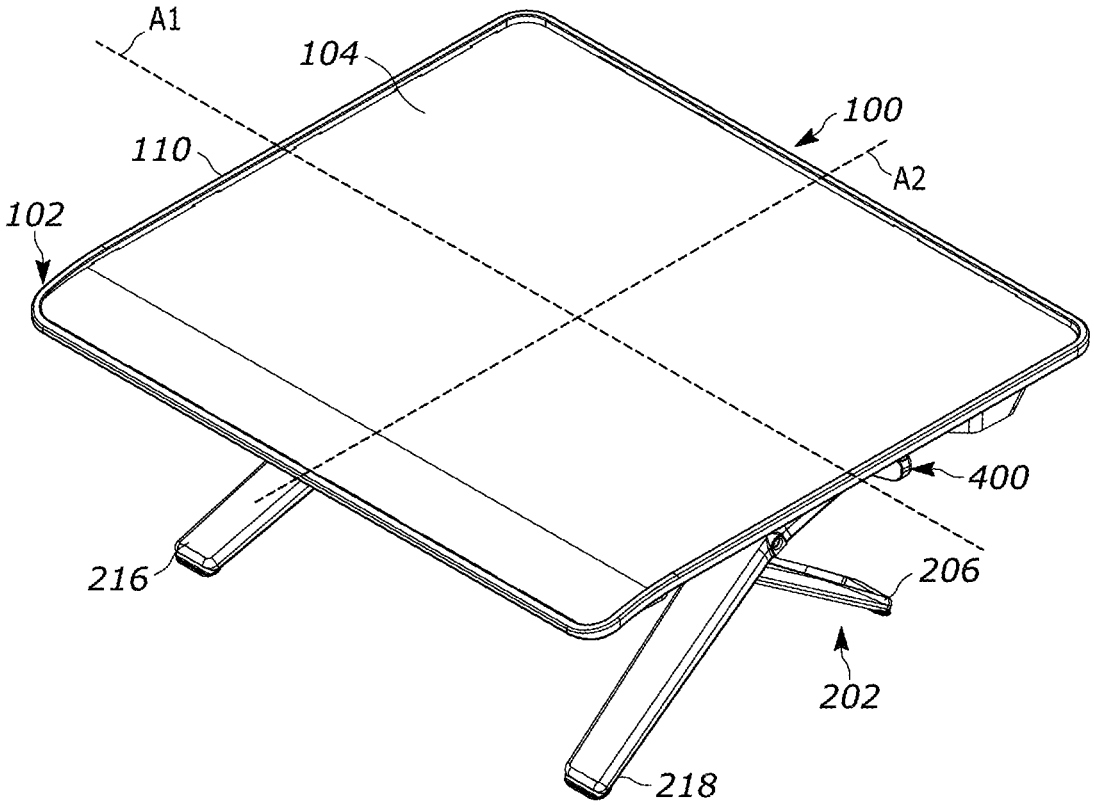
FIG. 1 is a top perspective view of a height adjustable work surface.
Figure 2:
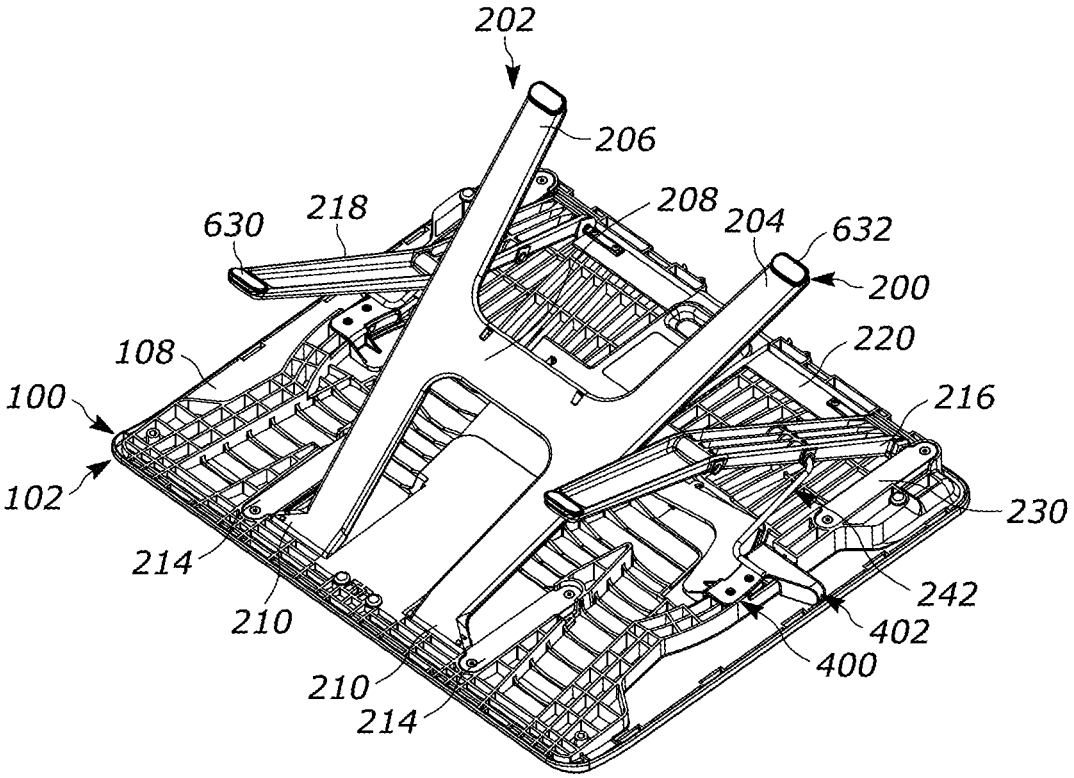
FIG. 2 is a bottom perspective view of the height adjustable work surface.
Figure 7:
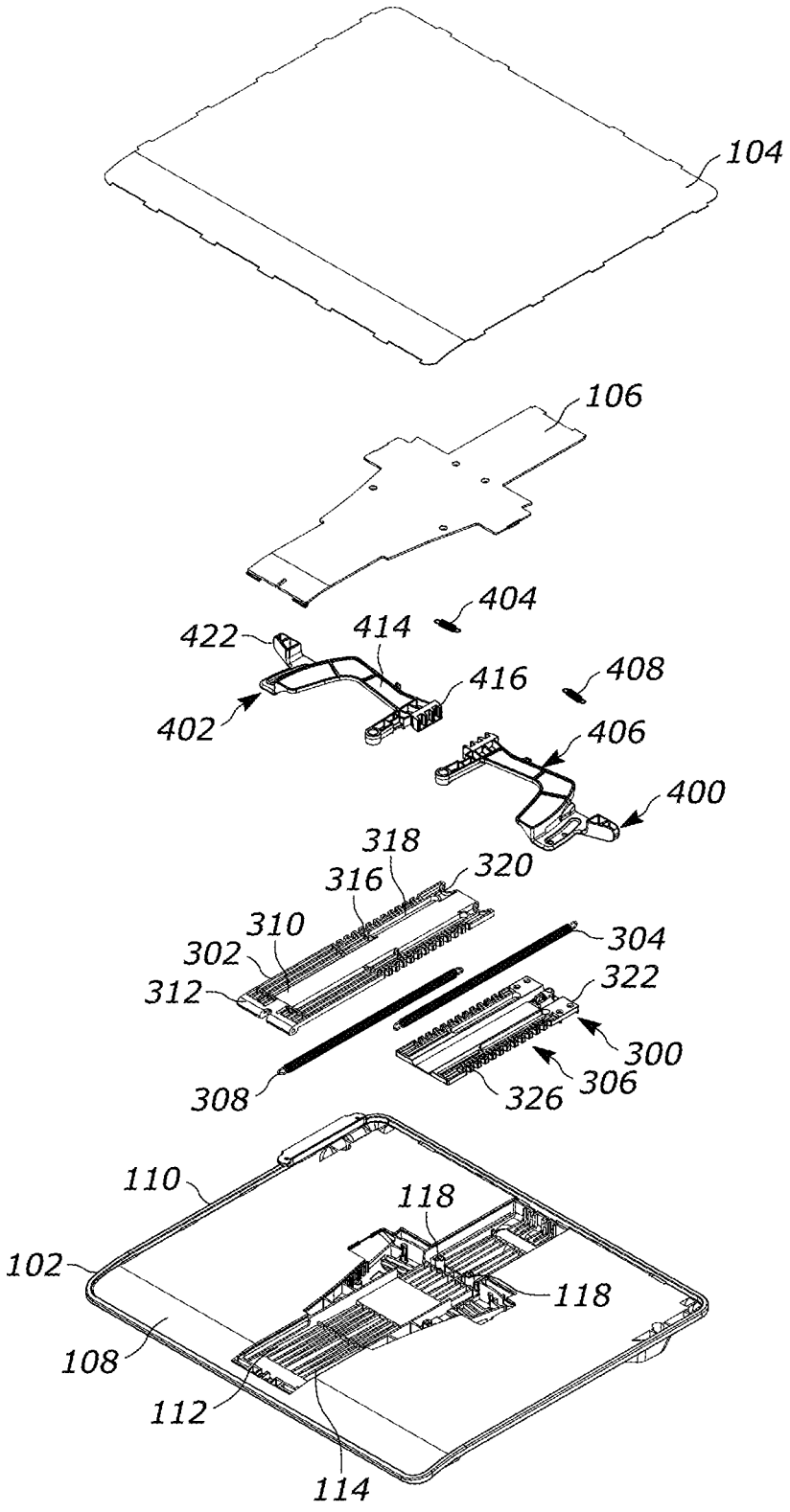
FIG. 7 is a partial exploded view of the height adjustable work surface showing parts of the platform, height adjustment assembly and locking assembly.
Figure 8:
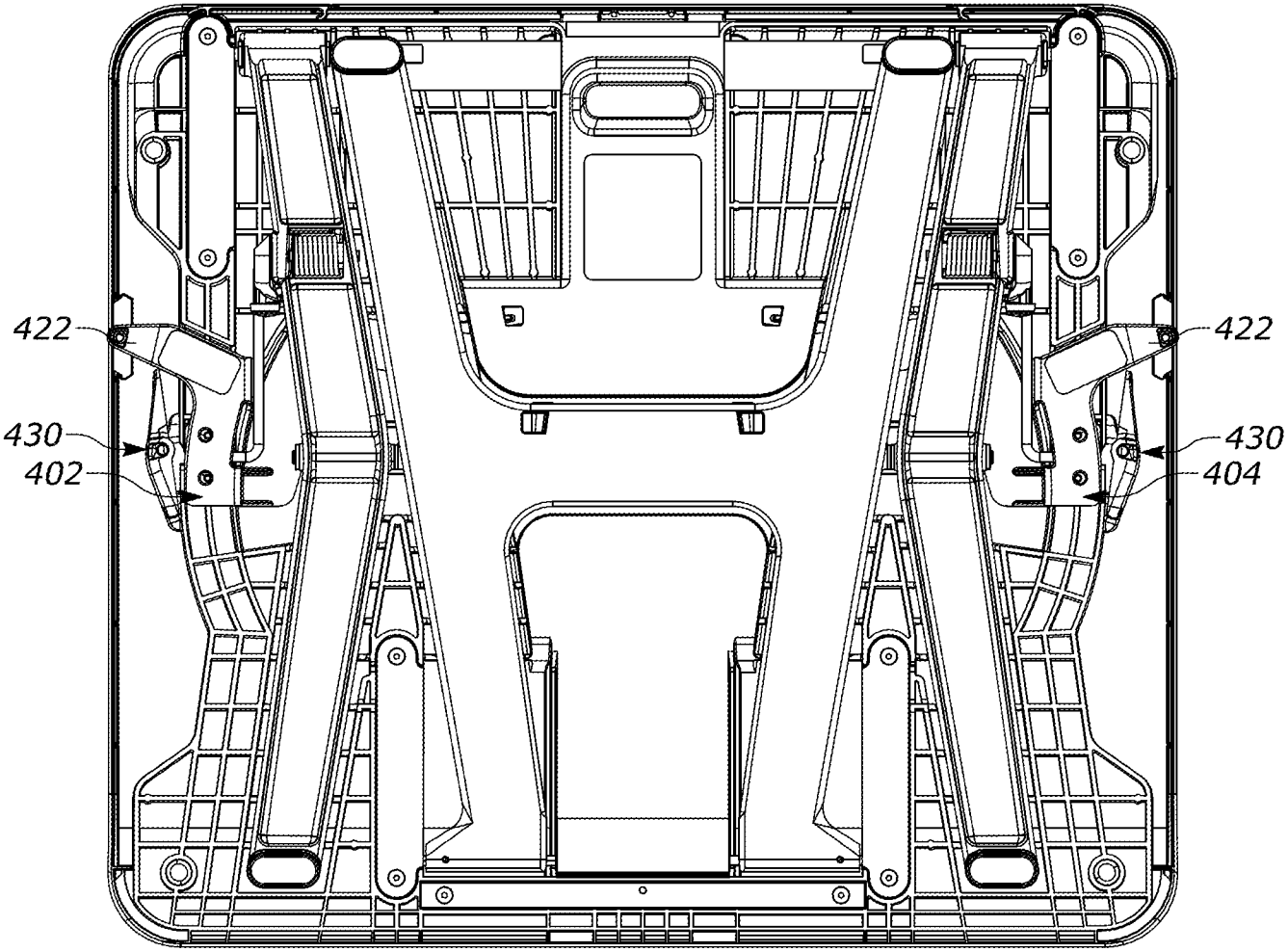
FIG. 8 is a bottom view of a height adjustable work surface having a latch.

As best shown in FIGS. 1, 2, and 7, the platform 100 can include a main body 102, an outer cover 104, and an inner cover 106. The main body 102 includes a base 108 and an outer rim 110 raised from and surrounding at least a portion of the base 108. A central opening 112 is formed in the base 108, exposing a recessed tray 114 that receives components of the height adjustment assembly 300 and the locking assembly 400. In an exemplary embodiment the opening 112 has a substantially cross-shaped configuration. The inner cover 106 fits over the central opening 112 and is connected to the base 108 through one or more fasteners. The inner cover 106 is positioned over the height adjustment assembly 300 components. The outer cover 104 is connected to the main body 102 over the inner cover 106 to provide a substantially planar outer surface for the platform 100. In an exemplary embodiment, cable management clips can be connected to the rear of the main body 102.

As best shown in FIG. 2, the leg assembly 200 can include a pair of legs connected in a scissor fashion to raise and lower the platform 100. In an exemplary embodiment, the leg assembly 200 includes an H-leg 202 rotatably and slidably connected to the front of the platform 100. The H-leg 202 includes a first leg 204, a second leg 206, and a crosspiece 208 connecting the first and second legs 204, 206. The first and second legs 204, 206 can extend at an angle to one another so that the distance between the first and second legs 204, 206 is less at the upper portion than at the lower portion. The H-leg 202 is illustrated as being formed as a monolithic piece, but can also be formed as separate pieces.

The leg assembly also includes a split-leg rotatably and slidably connected to the rear of the platform. The split-leg includes a third leg 216 and a fourth leg 218 that are connected to the platform 100 and to a plate 220 that extends between the third and fourth legs 216, 218. The plate 220 is also connected to the height adjustment assembly 300. Each of the third leg 216 and the fourth leg 218 are positioned on the outside of the H-leg 202 and can include an upper portion 222 that angles toward the interior of the platform 100 and a lower portion 224 that angles toward the exterior of the platform 100.

As shown in FIGS. 7, the height adjustment assembly 300 includes an H-leg slider 302, an H-leg biasing mechanism 304, a split-leg slider 306, and a split-leg biasing mechanism 308. The H-leg slider 302 and split-leg slider 306 are positioned in the tray 114 and are configured to slide relative to one another as the platform 100 and leg assembly 200 are moved from the raised to the lowered position. The biasing mechanisms 304, 308 biasing the sliders 302, 306 to the raised position, allowing a user to more easily raise the platform 100 and any load supported thereon.

The H-leg slider 302 includes a body 310 having proximate end positioned toward the front of the platform 100 and a distal end positioned toward the rear of the platform 100. The proximate portion includes a connecting member 312 configured to receive pins from the H-leg assembly. The proximate portion also includes an attachment feature 314 that connects the H-leg biasing mechanism 304 to the body 310. The attachment feature 314 can include a hook, slot, channel or other feature configured to connect to an end of the H-leg biasing mechanism 304.

A plurality of teeth 316 are positioned along each side of the body 310 and are configured to engage the locking assembly 400. The teeth 316 are angled toward the distal end of the body 310. Movement of the H-leg slider 302 is guided by one or more slots formed in the body 310. The slots receive a protrusion extending from the tray 114, for example a cylindrical post or protrusion 118 as best shown in FIG. 9A. The protrusion 118 extends into the slot to confine the H-leg slider 302 to linear movement with respect to the tray 114. Notches 320 are formed in the distal end of the H-leg slider 302 and assist a user in connecting the H-leg biasing mechanism 304 during assembly.

The H-leg biasing mechanism 304 includes a first end connected to the H-leg slider 302 and a second end connected to the main body 102. A force is exerted by the H-leg biasing mechanism 304 to bias the H-leg slider 302 to the rear of the platform (i.e., the raised position). The first and second ends of the H-leg biasing mechanism 304 can include connecting features such as hooks or loops that allow the ends to be releasably connected. In an exemplary embodiment the H-leg biasing mechanism 304 includes a single coil extension spring having a hook formed in the first and second ends. Other types of biasing mechanisms, including gas springs, elastomeric springs, etc, can also be used.

The split-leg slider 306 includes a body 322 having a proximate end positioned toward the front of the platform 100 and a distal end positioned toward the rear of the platform 100. The distal portion of the body 322 is connected to the plate 220. The distal portion also includes a connection 324 for the split-leg biasing mechanism 308. The connection 324 can include a hook, slot, channel or other feature configured to connect to an end of the split-leg biasing mechanism 308. The body 322 also includes a plurality of teeth 326 along each side of the body 322 that are configured to engage the locking assembly 400. The teeth 326 are angled toward the distal end of the body 322. The teeth 326 of the split-leg body 322 are also configured to align with the teeth 316 of the H-leg body 310. Movement of the split-leg slider 306 is guided by one or more slots formed in the body. The slots receive a protrusion 118, for example a cylindrical post, extending from the tray 114. The protrusion 118 extends into the slot to promote translation of the split-leg slider 306 with respect to the tray 114. In an exemplary embodiment, the protrusions 118 extend through the slots in both the H-leg slider 302 and the split-leg slider 306.

The split-leg biasing mechanism 308 includes a first end connected to the main body 102 and a second end connected to the split-leg slider 306. A force is exerted by the split-leg biasing mechanism 308 to bias the split-leg slider 306 to the front of the platform 100 (i.e., the raised position). The first and second ends of the split-leg biasing mechanism 308 can include a connecting feature such as hooks or loops that allow the ends to be releasably connected. In an exemplary embodiment the split-leg biasing mechanism 308 includes a single coil extension spring having a hook formed in the first and second ends. Other types of biasing mechanisms can also be used.

According to various exemplary embodiments, the locking assembly 400 includes a first arm 402, a first arm biasing mechanism 404, a second arm 406, and a second arm biasing mechanism 408. The first and second arms 402, 406 are moveably connected to opposite sides of the main body 102 between a locked position that prevents movement of the leg assembly 200 and a released position that allows movement of the leg assembly 200. The first and second arms 402, 406 can extend from underneath the platform 100 and be accessible to a user to engage and disengage the locking assembly 400. In an exemplary embodiment, the locking assembly 400 directly engages with the slider assembly 300 to prevent movement, although other configurations (e.g., direct engagement with the leg assembly) can also be used. The first and second arm biasing mechanisms 404, 408 bias the arms 402, 406 into the locked position.

A first body portion 414 of the arm extends away from the cylindrical wall. A set of arm teeth 416 are formed in the first body portion 414. The arm teeth 416 angle toward the proximate portion of the platform 100 and are configured to releasably mate with the teeth 316, 326 of the slider assembly 300. The size of the arm teeth 416 allows them to mate with both the H-leg slider teeth 316 and the split-leg slider teeth 326. A handle 422 extends underneath the platform 100 and is configured for user engagement. For example, by pulling the handles 422, the user can rotate the first arm 402 and/or the second arm 406 to disengage the arm teeth 416 from the slider assembly 300.

In the illustrated embodiment, the first and second arms 402, 406 are mirror images of each other and share the same structural features. As such, only a single arm is described in detail. Other exemplary embodiments can include arms with different structures. Some embodiments can utilize a single moveable arm for the locking assembly. The first and second arms are also shown as unitarily formed or monolithic members, although they can also be formed in separate parts.

Use of the two arms as shown and described requires that both arms must be intentionally moved by the user to release the height adjustment assembly 300 for movement in either direction. This helps prevent inadvertent movement of the platform 100. In an exemplary embodiment, the arms 402, 406 are positioned to be at least partially along mid-line C1 of the riser. This allows the user to more easily raise or lower the platform compared with handles that are positioned closer to the user.

In certain exemplary embodiments, the locking assembly 400 includes a latch 430 as shown in FIGS. 8-11. The latch 430 is configured to engage the handle 422 of one of the arms 402, 406. In the illustrated embodiment, a pair of latches 430 are used with one engaging each arm 402, 406. In other embodiments, only one latch 430 can be used.

Figure 9:
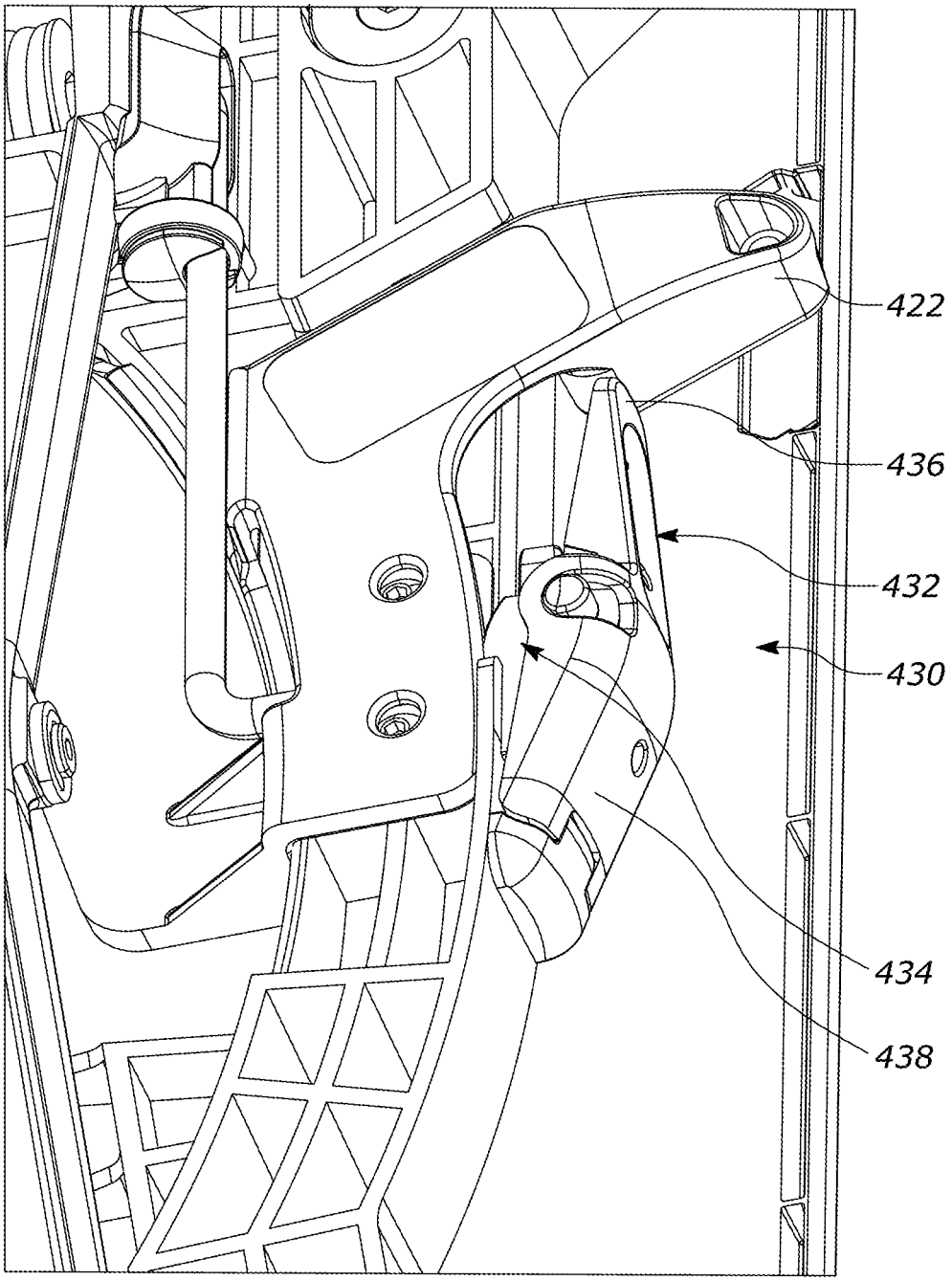
FIG. 9 is a close-up view of a portion of FIG. 8 showing the latch in the locked position.
Figure 10:
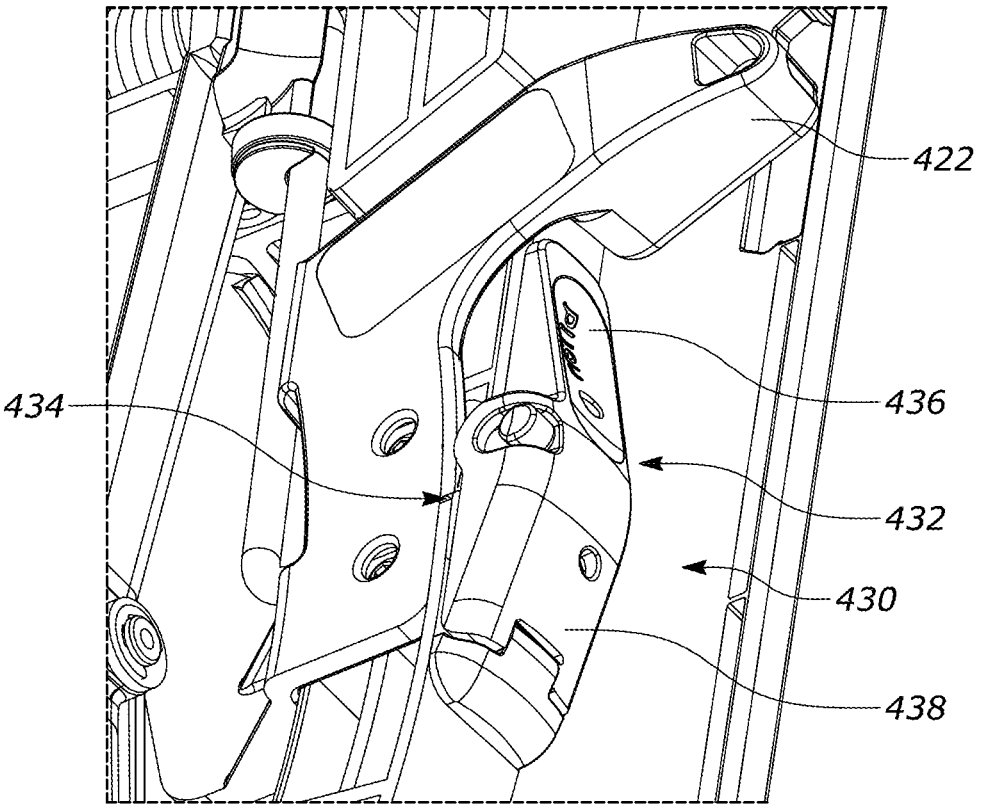
FIG. 10 is a close-up view of a portion of FIG. 8 showing the latch in the unlocked position.
Figure 11:
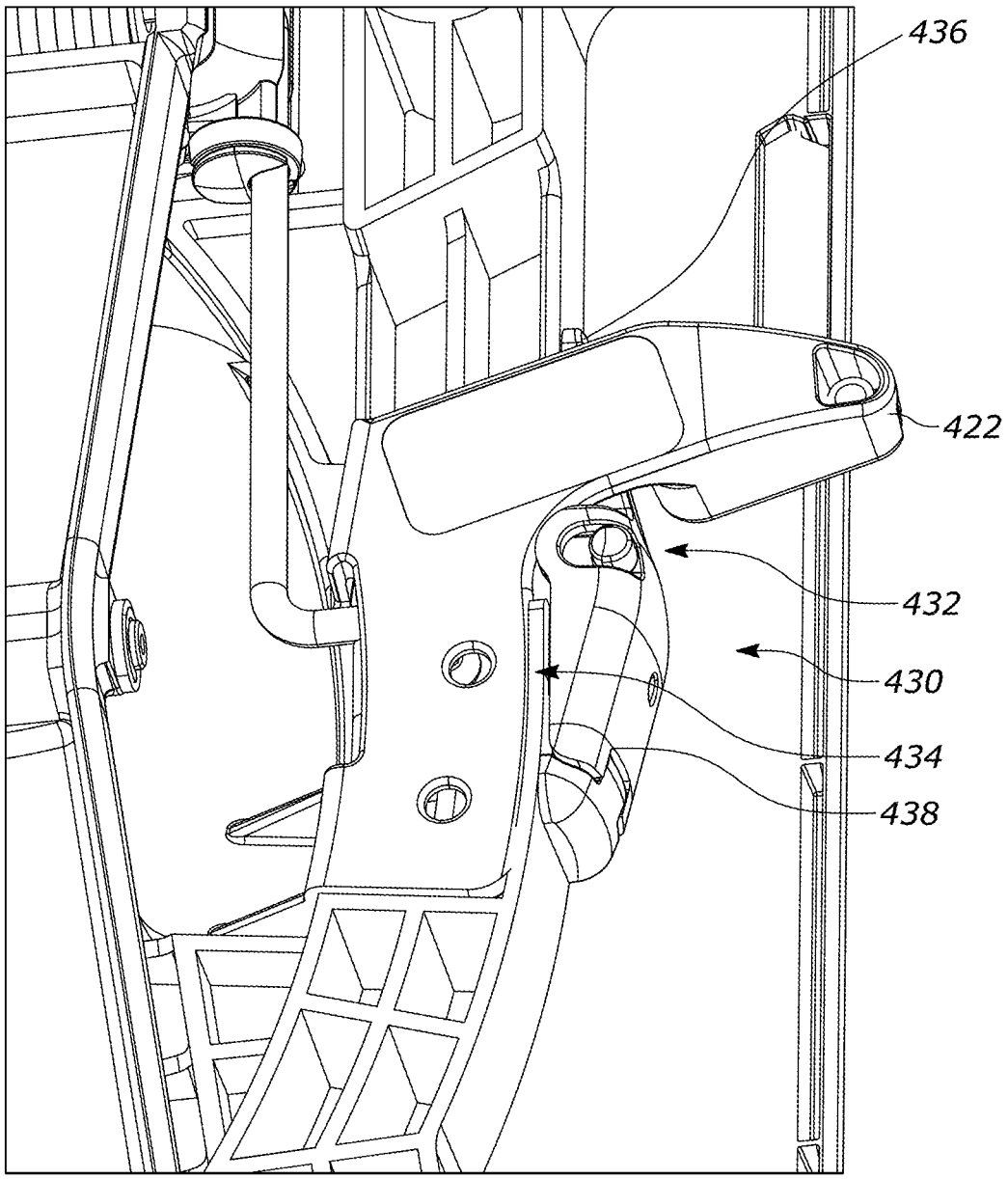
FIG. 11 is a close-up view of a portion of FIG. 8 showing the latch in the unlocked position and the handle sliding over the latch.

As best shown in FIGS. 9-11, the latch 430 includes an actuator 432 and a latch body 434. The actuator 432 includes a first end 436 extending towards the handle 422 and a second end 438 extending away from the handle 422. The actuator is 432 can be pivotally connected to the body 434, for example, at or near the second end 438. The first end 436 is configured to engage the handle 422 when in a first position as shown in FIG. 9. The first end 436 can be depressed by a user, pivoting the actuator 432 to a second position as shown in FIG. 10. In the second position, the user can slide the handle 422 over the latch 430 as shown in FIG. 11, allowing the user to adjust the height of the platform 100. The actuator 432 can be biased toward the first position. In this way, the user needs to depress the one or more latches 130 prior to releasing the handles 422.

In certain configurations, the latch 430 can include a lockout mechanism that prevents the actuator 432 from moving to the second position to disengage the handle. The lockout mechanism can be automatically engaged and disengaged based on the orientation of the platform 100. For example, the lockout mechanism can be configured to be disengaged only when the platform is in a normal operating orientation, that is with the front, rear, and side edges of the platform substantially level (or within a certain range of level) and the legs facing down as shown in FIG. 1. In certain embodiments, the platform need not be perfectly level to be in the normal operating orientation and disengage the lock-out mechanism, instead the normal operating orientation can includes a certain range of angles, for example between an angle of 0 to 45 degrees or less (e.g., 10, 15, 20, 30) in both the positive and negative directions, with zero being where the platform is parallel to the ground. The lockout angle can be both relative to a pitch axis A1 (front to back) and roll axis A2 (side to side) as shown in FIG. 1. In this way, the lockout mechanism can prevent the handles from being actuated and the legs from being deployed from the storage position when the platform is displaced from a normal operating angle. This can be useful, for example, to ensure that the legs are not deployed by the user when the worksurface is being carried or has the legs facing up toward the user. In certain configurations, two lockout mechanisms are needed, one associated with each handle to ensure the disengagement of at least one handle through all desired lockout angles. In certain aspects, the lockout mechanism can achieve this capability by using gravity to engage and disengage the lockout mechanism.

Figure 12:
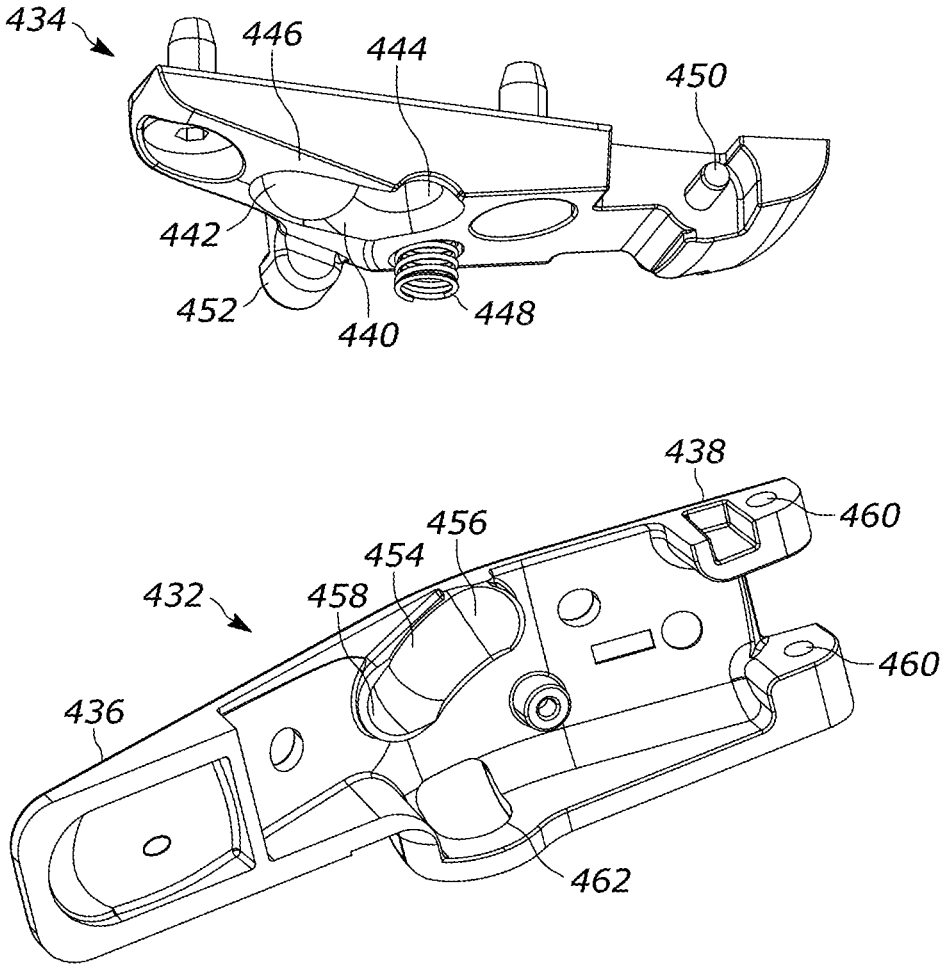
FIG. 12 is a partially-exploded view of the latch.

FIG. 12 shows an exemplary embodiment of a gravity-actuated lockout mechanism for the latch 430. The body 434 includes a first track 440 for receiving a ball 442, the first track 440 includes an upper cup 444 and a lower cup 446. A biasing mechanism 448 is connected to the body 434 and extends between the body 434 and the actuator 432. In the illustrated embodiment, the biasing mechanism 448 is received in a well formed in the body 434, but can be connected to the body 434 using other methods or structures. A pivot pin 450 extends from the body 434 to pivotally connect the actuator 432. The body 434 also includes a side protrusion 452 which engages the actuator 432 to limit the movement of the actuator 432 relative to the body 434.

The actuator 432 includes a second track 454 aligned with the first track 440. The second track 454 can have an upper portion 456 and a lower portion 458. In certain configurations, however, only a single track is needed. A pair of rear openings 460 are formed in the sides of the actuator for receiving the pivot pin 450. A slot 462 is formed in the side of the actuator for receiving the protrusion 452.

The first track 440 can have a variable curvature along both the length of the track and from side to side. The first track 440 can also extend at an oblique angle to the longitudinal axis of the latch body 434. This allows the ball 442 to move with gravity depending on the orientation of the platform between the upper cup 444 and the lower cup 446.

Figure 13:
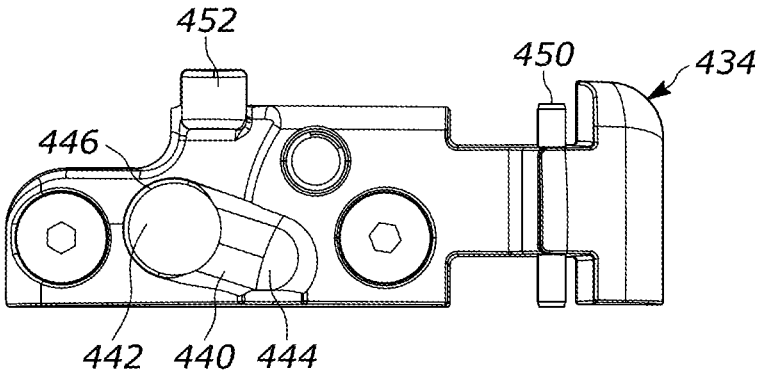
FIG. 13 is a plan view of the latch body.
Figure 14:
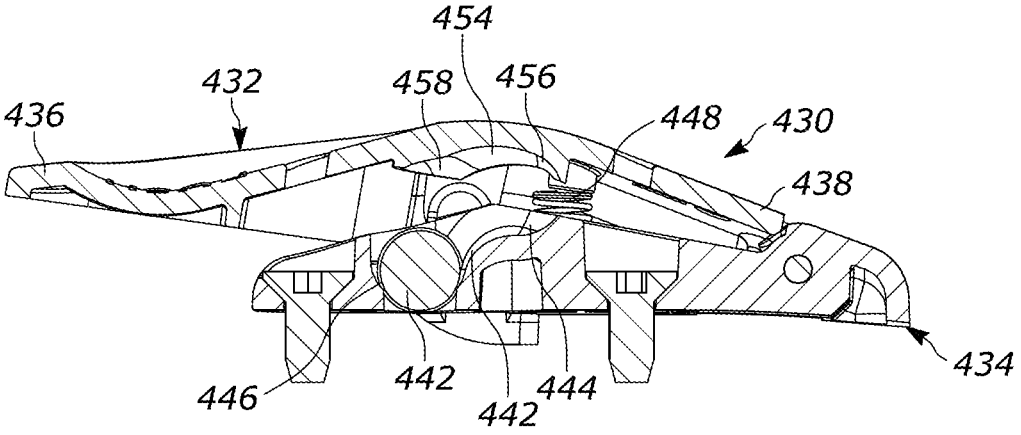
FIG. 14 is a sectional view of the latch with the lockout mechanism in the disengaged position.

FIGS. 13 and 14 show the position of the ball 442 in the lower cup 446 which can correspond to when the platform 100 is in a normal operating orientation. In this position, the actuator 432 can be pivoted relative to the body 434 and the first end 436 of the actuator 432 can be moved to the second position so that the handle 422 can be slid over the latch 430.

Figure 15:
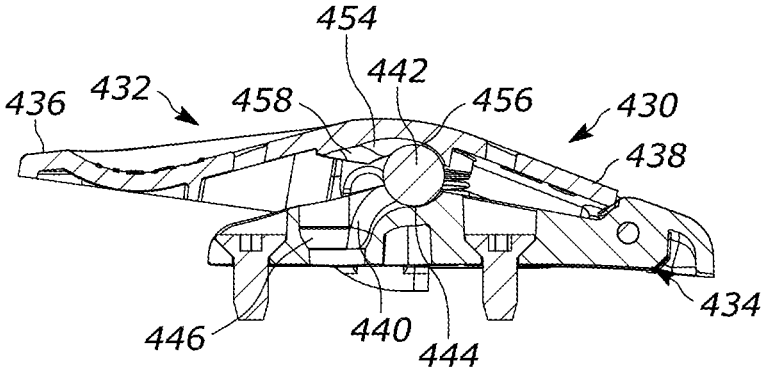
FIG. 15 is a sectional view of the latch with the lockout mechanism in the engaged position.

FIG. 15 shows the position of the ball 442 in the upper cup 444 which can correspond to when the platform 100 is outside of the normal operating orientation. In this position, the ball 442 can be near or engaged with the upper portion 456 of the second track 454. Here the ball 442 prevents the actuator 432 from being depressed, and the first end 436 of the actuator 432 will remain in an engagement position relative to the handle 422 and thus resisting or preventing movement of the handle 422.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A height adjustable work surface comprising:

a platform;

a height adjustment assembly moveably connected to the platform;

a leg assembly connected to the height adjustment assembly and moveably connected to the platform, wherein the leg assembly is moveable between a raised position and a lowered position; and a locking assembly moveably connected to the platform, the locking assembly configured to engage the height adjustment assembly to selectively secure the leg assembly in the raised position and the lowered position, wherein the locking assembly includes a handle and a latch, wherein at least a portion of the latch is moveable between a first position and a second position, and wherein the latch includes a gravity actuated lockout mechanism configured to prevent movement of the latch to the second position unless the platform is in a normal operating orientation.

2. The height adjustable work surface of claim 1, wherein the normal operating orientation is in a range of 45 degrees or less about a pitch axis and a roll axis of the platform.

3. The height adjustable work surface of claim 1, wherein the latch includes an actuator pivotally connected to a latch body.

4. The height adjustable work surface of claim 3, wherein a biasing mechanism biases an end of the actuator away from the latch body.

5. The height adjustable work surface of claim 1, wherein the lockout mechanism includes a ball positioned in a track.

6. The height adjustable work surface of claim 5, wherein the track includes an upper cup and a lower cup.

7. The height adjustable work surface of claim 6, wherein the track has a variable curvature along the length of the track.

8. A height adjustable work surface comprising:

a platform;

a height adjustment assembly moveably connected to the platform;

a leg assembly connected to the height adjustment assembly and moveably connected to the platform, wherein the leg assembly is moveable between a raised position and a lowered position;

a handle moveably connected to the platform, the handle configured to engage the height adjustment assembly to selectively secure the leg assembly in the raised position and the lowered position; and a latch connected to the platform, wherein at least a portion of the latch is moveable between a first position configured to engage the handle and a second position configured to allow the handle to pass around the latch, wherein the latch includes a lockout mechanism configured to be automatically engaged and disengaged based on the orientation of the platform, wherein when the lockout mechanism is engaged it prevents movement of the portion of the latch to the second position.

9. The height adjustable work surface of claim 8, wherein the lockout mechanism is engaged when the platform is in a normal operating orientation in a range of 45 degrees or less about a pitch axis and a roll axis of the platform.

10. The height adjustable work surface of claim 8, wherein the latch includes an actuator pivotally connected to a latch body.

11. The height adjustable work surface of claim 10, wherein the lockout mechanism includes a ball positioned in a track in the latch body.

12. The height adjustable work surface of claim 11, wherein the track includes an upper cup and a lower cup.

13. The height adjustable work surface of claim 12, wherein the ball is positioned in the upper cup in the engaged state and the ball is positioned in the lower cup in the disengaged state.

14. The height adjustable work surface of claim 11, wherein the track extends at an oblique angle to a longitudinal axis of the latch body.

15. The height adjustable work surface of claim 11, wherein the ball resists movement of the actuator in the engaged state.

16. A height adjustable work surface comprising:

a platform;

a height adjustment assembly moveably connected to the platform;

a leg assembly connected to the height adjustment assembly and moveably connected to the platform, wherein the leg assembly is moveable between a raised position and a lowered position;

a handle moveably connected to the platform, the handle configured to engage the height adjustment assembly to selectively secure the leg assembly in the raised position and the lowered position;

a latch body connected to the platform, the latch body including a track;

a ball received in the track and moveable between an engaged position and a disengaged position; and an actuator pivotally connected to the latch body, wherein the actuator is moveable between a first position configured to engage the handle and a second position configured to allow the handle to pass around the actuator, wherein the ball is configured to prevent movement of the actuator to the second position when the ball is in the engaged position.

17. The height adjustable work surface of claim 16, wherein the ball is moveable by gravity between the engaged position and the disengaged position.

18. The height adjustable work surface of claim 16, wherein the actuator includes a second track configured to receive the ball.

19. The height adjustable work surface of claim 16, wherein a biasing member biases an end of the actuator away from the latch body.

20. The height adjustable work surface of claim 16, wherein the track extends at an oblique angle to a longitudinal axis of the latch body.

* * * * *